US008216015B2

(12) United States Patent
Below

(10) Patent No.: US 8,216,015 B2
(45) Date of Patent: Jul. 10, 2012

(54) HIGH THREAD GROUND SHIELD

(75) Inventor: Matthew B. Below, Findlay, OH (US)

(73) Assignee: Fram Group IP LLC (NZ)

( * ) Notice: Subject to any disclaimer, the term of this patent is extended or adjusted under 35 U.S.C. 154(b) by 0 days.

(21) Appl. No.: 13/181,064

(22) Filed: Jul. 12, 2011

(65) Prior Publication Data

US 2012/0028530 A1 Feb. 2, 2012

Related U.S. Application Data

(62) Division of application No. 12/360,492, filed on Jan. 27, 2009, now Pat. No. 7,977,857.

(60) Provisional application No. 61/024,054, filed on Jan. 28, 2008.

(51) Int. Cl.
*H01T 21/02* (2006.01)

(52) U.S. Cl. ..... 445/7

(58) Field of Classification Search ..... 445/7; 313/141, 313/143

See application file for complete search history.

(56) References Cited

U.S. PATENT DOCUMENTS

| | | | |
|---|---|---|---|
| 2,296,033 | A | 9/1942 | Heller |
| 5,091,672 | A | 2/1992 | Below |
| 5,697,334 | A | 12/1997 | Below |
| 5,918,571 | A | 7/1999 | Below |
| 6,104,130 | A | 8/2000 | Below |
| 2005/0168120 | A1 | 8/2005 | Kanao et al. |

FOREIGN PATENT DOCUMENTS

| | | | |
|---|---|---|---|
| JP | 3569769 | B2 | 9/2004 |
| JP | 2006012464 | A | 1/2006 |

OTHER PUBLICATIONS

International Search Report—PCT/US2009/032110 dated Aug. 31, 2009.

Written Opinion—PCT/US2009/032110 dated Aug. 31, 2009.

*Primary Examiner* — Vip Patel

(74) *Attorney, Agent, or Firm* — Barnes & Thornburg LLP

(57) ABSTRACT

A method of forming a spark plug for an internal combustion engine is provided, the method including the steps of: separately securing a ground electrode to a ground shield, the ground shield having an elongated base section being configured to substantially surround a first insulator section of an insulator configured to substantially surround a center electrode, the insulator having a substantially cylindrical body with at least the first insulator section and a second insulator section, the first and second insulator sections having first and second diameters respectively and being separated by an insulator shoulder; and the elongated center electrode having a center electrode tip at one end and a terminal proximate another end of the center electrode, wherein the ground shield has a frustoconical flange protruding from a first end of the elongated base section, the frustoconical flange being configured to engage the insulator shoulder, and wherein the ground electrode extends from a second end of the elongated base section to define a spark gap with respect to the center electrode tip; and securing the ground shield to the spark plug after the ground electrode has been separately secured to the ground shield.

18 Claims, 4 Drawing Sheets

HIGH THREAD GROUND SHIELD

CROSS REFERENCE TO RELATED APPLICATION

This application is a divisional of U.S. patent application Ser. No. 12/360,492 filed Jan. 27, 2009, which claims the benefit of the following U.S. Provisional Patent application Ser. No. 61/024,054 filed Jan. 28, 2008, the contents of which are incorporated herein by reference thereto.

BACKGROUND

This application relates generally to spark plugs for internal combustion engines and, more particularly, to a ground shield for a spark plug having an annular threaded portion for engaging the engine with a spark plug seat that is located between the spark gap and the threaded portion.

Traditional spark plug construction includes an annular metal casing having threads near one end and a ceramic insulator extending from the threaded end through the metal casing and beyond the opposite end. A central electrode is exposed near the threaded end and is electrically connected through the insulator interior to a terminal which extends from the opposite insulator end to which a spark plug ignition wire attaches. A "J" shaped ground electrode extends from one edge of the threaded end of the metal casing into axial alignment with the central electrode to define a spark gap therebetween. The force applied to seal the spark plug in the head is the result of torque transmitted by the threaded metal casing; hence, the threaded portion of the metal casing must be sturdy and of substantial size. A portion of the metal casing is formed to be engaged by a socket tool to provide torque to the threaded portion. The threaded portion is located away from the portion which is engaged by the socket tool.

To facilitate the controlled and efficient exhaust of gases from a combustion chamber, the valves are sometimes increased in size. This may necessitate a decrease in the size of the spark plug, a reduction in the size and sturdiness of the threaded metal casing end, and, in particular, a decrease in the inside diameter of the metal bore of the spark plug and in the combustion chamber wall area available to threadedly receive the spark plug.

The decrease in the inside diameter of the metal bore of the spark plug reduces the ability of the spark plug to resist carbon build up and similar deposits reducing ignition efficiency. Various designs for spark plugs that reduce the deleterious effect of reducing the spark plug size by having an insulator with a cylindrical body that surrounds a central electrode are taught in U.S. Pat. Nos. 5,091,672, 5,697,334, 5,918,571, and 6,104,130, the contents for each incorporated herein by reference. In these designs, the cylindrical body is provided with a first diameter section separated from a second diameter section by a shoulder that provides a surface for sealing to the engine cylinder head. A shield that surrounds the second diameter has a base portion that is positioned a fixed distance from the tip to the center electrode by the engagement of a flange on the shield with the shoulder on the cylindrical body. The shield is formed with a ground electrode that integrally extends from the base portion. A shell portion surrounds the first diameter section of the cylindrical body and contains a threaded section positioned higher than the cylinder head seating surface along the cylindrical body. A radial tab extends from an end of the shell and aligns with the flange within the head to establish uniform positioning of the base portion. A separate end or retainer nut extends from the opposing end of the shell to locate and position the spark plug within the combustion chamber.

Particularly suited for high-compression, high-performing engines, these various high-thread spark plug designs can provide more power by allowing for more space to optimize engine design, a superior cylinder head-seating position, a more compressive seal, improved heat transfer, and a more stable spark plug operating temperature for a more focused ignition, as well as a longer service life and increased corrosion protection. Nevertheless, to maintain the sparking gap between the center electrode and the ground electrode, the ground shield must be manufactured from an expensive, proprietary nickel alloy material.

Accordingly, the inventor herein has recognized that it is desirable to provide a cost effective ground shield for use in a high-thread spark plug structure.

SUMMARY

Exemplary embodiments of the present invention relate to a spark plug for an internal combustion engine. In one embodiment, a method of forming a spark plug for an internal combustion engine is provided, the method including the steps of: separately securing a ground electrode to a ground shield, the ground shield having an elongated base section being configured to substantially surround a first insulator section of an insulator configured to substantially surround a center electrode, the insulator having a substantially cylindrical body with at least the first insulator section and a second insulator section, the first and second insulator sections having first and second diameters respectively and being separated by an insulator shoulder; and the elongated center electrode having a center electrode tip at one end and a terminal proximate another end of the center electrode, wherein the ground shield has a frustoconical flange protruding from a first end of the elongated base section, the frustoconical flange being configured to engage the insulator shoulder, and wherein the ground electrode extends from a second end of the elongated base section to define a spark gap with respect to the center electrode tip; and securing the ground shield to the spark plug after the ground electrode has been separately secured to the ground shield.

DESCRIPTION OF EXEMPLARY EMBODIMENTS

Figure 1:
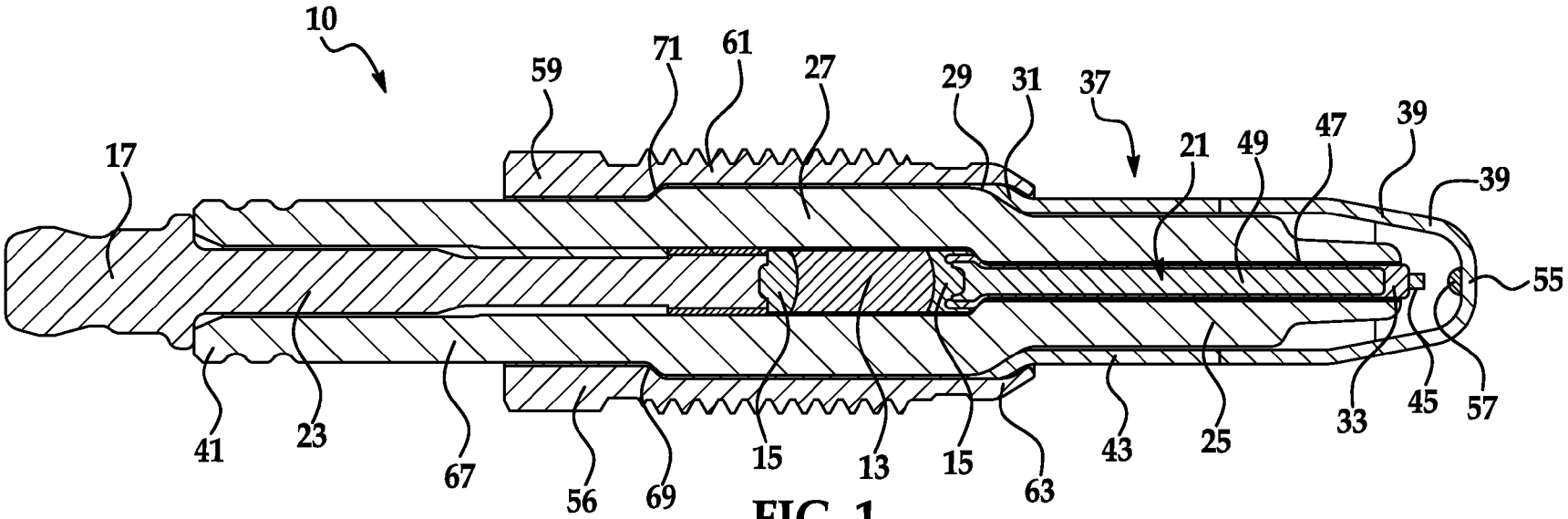
FIG. 1 is a cross-sectional view of a spark plug in accordance with an exemplary embodiment of the present invention.
Figure 3:
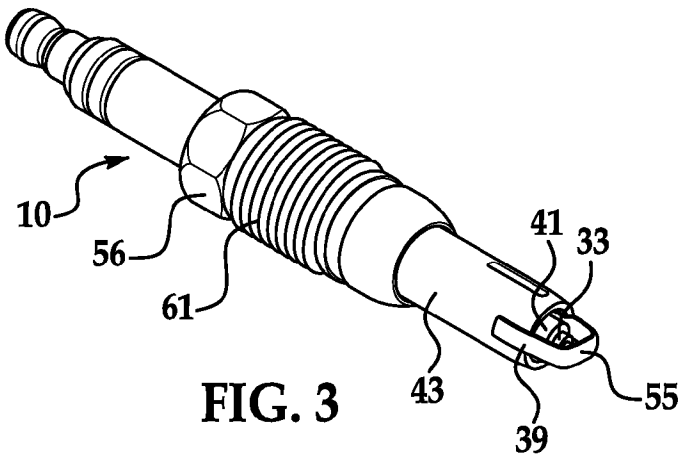
FIG. 3 is a perspective view of the exemplary spark plug illustrated in FIG. 1.
Figure 2:
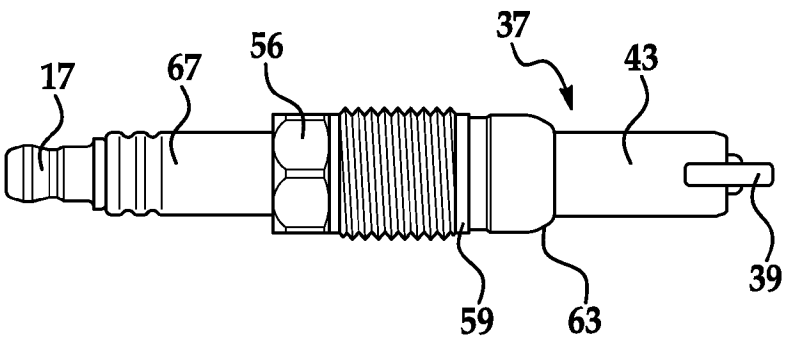
FIG. 2 is a side view of the exemplary spark plug illustrated in FIG. 1.
Figure 4:
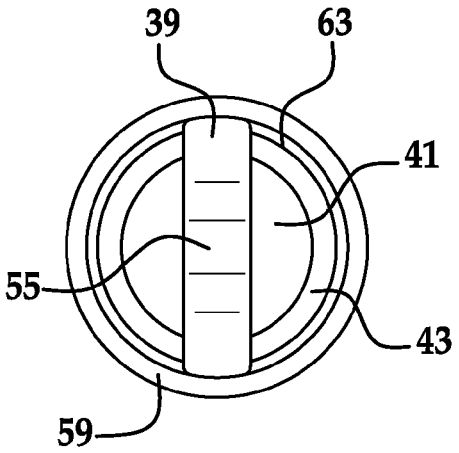
FIG. 4 is a side view of the sparking end of the exemplary spark plug illustrated in FIG. 1.

FIGS. 1-4 illustrate an overall structure of an exemplary embodiment of a high-thread spark plug employing a ground shield in accordance with the present invention. The spark plug 10 is designed for use in internal combustion engines of automotive vehicles. The installation of spark plug 10 into an internal combustion engine is achieved by fitting it so that it protrudes into a combustion chamber (not shown) of the engine through a threaded bore provided in the engine head (not shown). Spark plug 10 includes a cylindrical center electrode 21 extending along the axial length of the spark plug, a ceramic or similarly comprised insulator 41 that concentrically surrounds center electrode 21, and a cylindrical shell shaped ground shield 37 that concentrically surrounds insulator 41.

In the present exemplary embodiment, center electrode 21 has a cylindrical body with a tip 33 at one end, and is secured concentrically within insulator 41 to be electrically isolated from ground shield 37. The end of center electrode 21 opposing tip 33 is electrically connected to an end of a resistive element 13 through a glass seal 15 that comprises an electrically conductive material. In exemplary embodiments, glass seal 15 can be a fired-in seal (conductive or otherwise) that coaxially surrounds resistive element 13 such that it is located between the inner surface of insulator 41 and the outer surface of the resistive element. The other end of resistive element 13 is electrically connected, through the glass sealing material 15, to an end of a cylindrical terminal stud 23. Glass seal 15 serves as the electrical connection between terminal stud 23 and center electrode 21. Terminal stud 23, in turn, is attached to a terminal nut 17, which is configured to attach to the ignition cable (not shown) that supplies the electric current to the plug when the plug is installed.

In exemplary embodiments, center electrode 21 can comprise a core 49 made of a highly heat conductive metal material such as, for example, copper, covered by a longer than conventional sheath 47 made a highly heat-resistant, corrosion-resistant metal material such as, for example, Inconel, another nickel-based alloy, or other suitable metal or metal alloy. In exemplary embodiments, center electrode 21 can include a noble metal chip 45, such as one made from a gold, palladium, or platinum alloy in any suitable form for enabling proper spark plug functioning such as, for example, flat or finewire, that is joined to center electrode tip 33 to improve heat transfer and maintain the sparking gap. In exemplary embodiments, terminal stud 23 can comprise steel or a steel-based alloy material with a nickel-plated finish.

In the present exemplary embodiment, insulator 41 has an elongated, substantially cylindrical body with first 25, second 27, and third 67 insulator sections having different diameters. First insulator section 25 substantially surrounds center electrode 21. Second insulator section 27 is located intermediate first 25 and third 67 insulator sections and the diameter of the second insulator section 27 is greater than that of either of the other two insulator sections. Second insulator section 27 and narrower first insulator section 25 are separated by a shoulder 29, and the second insulator section and narrower third insulator section 67 are separated by a shoulder 69. In exemplary embodiments, insulator 41 can comprise a non-conducting ceramic material such as, for example, alumina ceramic so that it may fixedly retain center electrode 21 while preventing an electrical short between the center electrode and ground shield 37.

Ground shield 37, which surrounds first insulator section 25, includes a frustoconical section 31 at one end that is juxtaposed with insulator shoulder 29, a generally U-shaped ground electrode strap 39 that extends from and diametrically spans the ground shield near the opposing end, and a cylindrical base portion 43 axially extending between frustoconical section 31 and ground electrode strap 39. Base portion 43 concentrically surrounds first insulator section 25. Ground electrode strap 39 includes a free end 55 that faces and is axially spaced from a center electrode tip 33. In exemplary embodiments, free end 55 can include a noble metal chip 57, such as one made from a gold, palladium, or platinum alloy in finewire form, that is joined to ground electrode strap 39 to improve heat transfer and enhance durability. In exemplary embodiments in which noble metal chips 45, 57 are joined to center electrode tip 33 and ground electrode strap 39 respectively, the noble metal chips define the spark gap and serve as the sparking surfaces of the spark plug. In exemplary embodiments, noble metal chips 45, 57 can be joined to center electrode tip 33 and ground electrode strap 39 respectively by a joining technique such as brazing, laser welding, resistance welding, or plasma welding.

Figure 5:
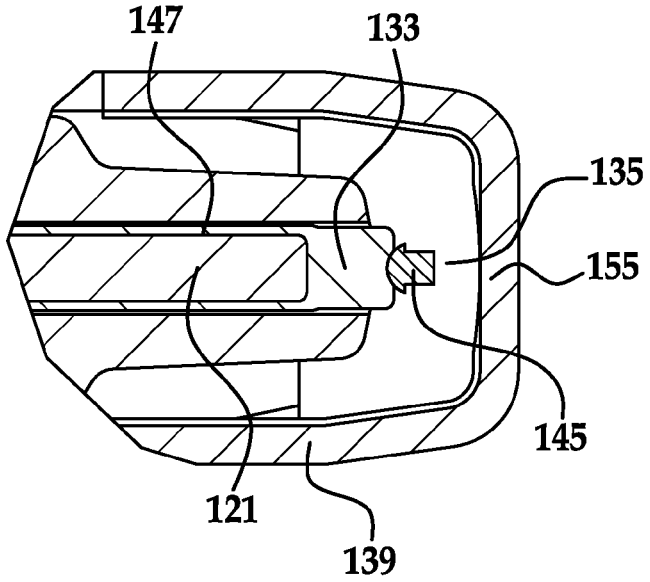
FIG. 5 is a partial cross-sectional view of a sparking end of an exemplary embodiment of a spark plug in accordance with the present invention.

As illustrated in detail in FIG. 5, exemplary embodiment of spark plugs in accordance with the present invention can comprise a ground electrode strap 139 that includes a free end 155 facing and axially spaced from a center electrode tip 133. Ground electrode strap 139 thus diametrically surrounds center electrode tip 133 to define an axial spark gap 135 therebetween, between which an electrical discharge can be passed to ignite a combustible mixture. Center electrode 121 can include a noble metal chip 145, such as one made from a gold, palladium, or platinum alloy in any suitable form for enabling proper spark plug functioning such as, for example, flat or finewire, that is joined to center electrode tip 133 to improve heat transfer and enhance durability.

Referring again to the exemplary embodiment illustrated in FIGS. 1-4, an annular retainer 59, such as a nut or a castle head jam screw, has a threaded portion 61 surrounding second insulator section 27. Annular retainer 59 extends axially to integrally form a jam nut 56 at one end that surrounds a portion of third insulator section 67. Threaded portion 61 is configured to threadedly engage the threaded portion of a generally cylindrical opening that is in communication with the combustion chamber of an internal combustion engine. With jam nut 56 being formed integrally with annular retainer 59, spark plug 10 can be removed in a helical pattern as the jam nut is unscrewed, resulting in easy, direct removal with negligible tipping. A suitable socket tool such as, for example, a 9/16 socket wrench, can engage jam nut 56 of annular retainer 59 for screwing spark plug 10 into and out of the engine bore.

Annular retainer 59 includes a frustoconical portion 63 that is situated below threaded section 61 and overlaps frustoconical section 31 of ground shield 37 in juxtaposed alignment with insulator shoulder 29. At this juncture, ground shield 37 and retainer 59 are secured together, with the insulator 41 being captured therewithin. Annular retainer 59 also includes a frustoconical portion 71 axially extending between threaded portion 61 and jam nut 56 that engages insulator shoulder 69. Third insulator section 67 protrudes from annular retainer 59 beyond jam nut 56. In exemplary embodiments, annular retainer 59 can comprise a conductive metal material such as a nickel-plated, low-carbon steel-based alloy. In exemplary embodiments, threaded section 61 can have an outer thread diameter of about 16 mm or less; for example, the threaded section can have an outer diameter of about 10 mm to allow for a greater amount of engine space. The shape, size, and particular construction of annular retainer 59 may, of course, vary greatly from one design to another; hence, the dimensional attributes of the annular retainer are provided in FIGS. 1-3 only as an exemplary embodiment.

When spark plug 10 is threaded into the engine bore, insulator 41 provides a compressive force that transmits a mechanical connection between retainer 59 and ground shield 37 by urging ground shield frustoconical portion 31 into sealing engagement with annular retainer frustoconical portion 63. Frustoconical portion 63 will, in turn, be urged to act as the external motor seat for sealingly engaging a frustoconical sealing seat portion of the engine bore (not shown) and thus establish an electrical ground connection between ground shield 37 and the engine head while at the same time sealing the combustion chamber from the surrounding environment. The assembled annular retainer 59 and ground shield 37 thus function as a unit and may be referred to herein as the ground shield and retainer unit. In exemplary embodiments, frustoconical portion 63 of annular retainer 59 and frustoconical section 31 of ground shield 37 can also be joined to one another using a joining technique such as brazing, laser welding, resistance welding, or plasma welding, to secure the ground shield and the retainer together.

Figure 6:
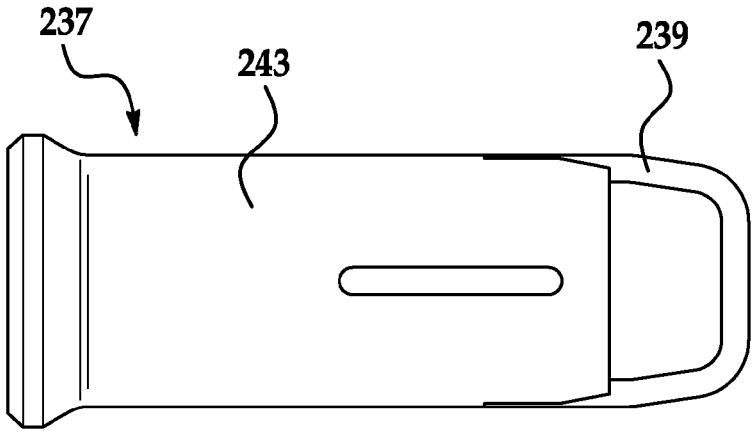
FIGS. 6 and 7 are side views of a ground shield for a spark plug in accordance with an exemplary embodiment of the present invention.
Figure 7:
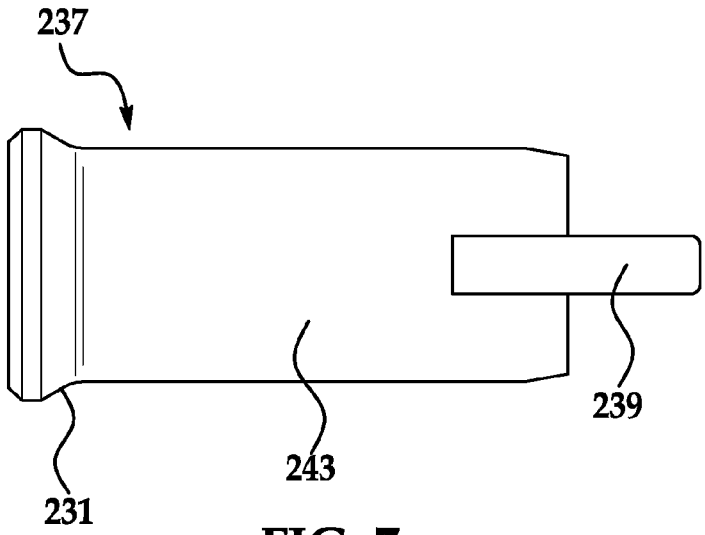
Figure 8A:
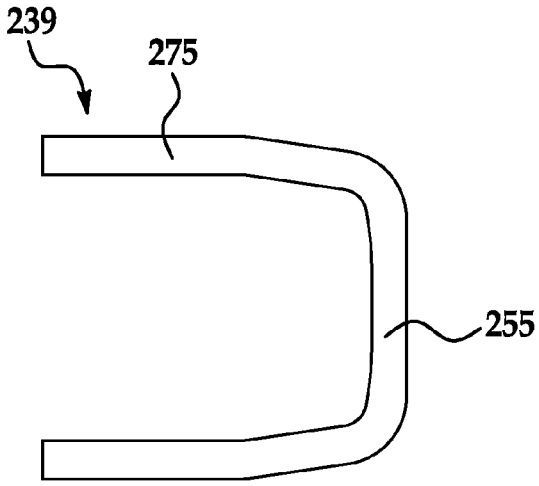
FIG. 8 shows various views of a ground electrode of the exemplary ground shield illustrated in FIGS. 6 and 7.
Figure 8B:
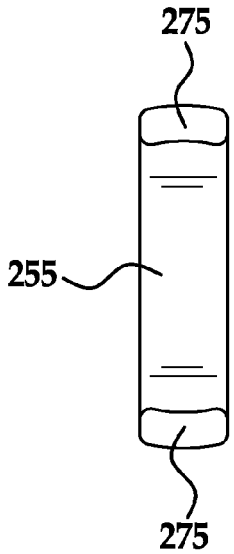
Figure 8C:
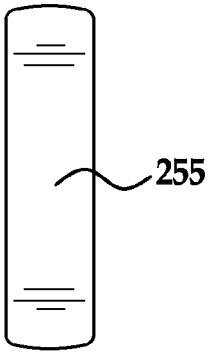
Figure 8D:
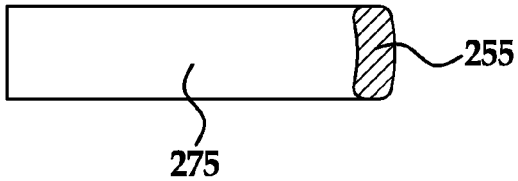
Figure 9A:
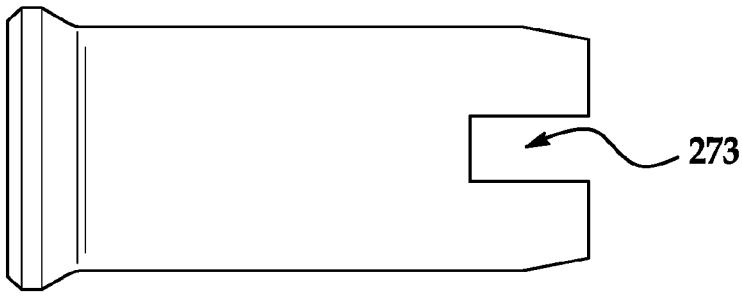
FIG. 9 shows various views of a base section of the exemplary ground shield illustrated in FIGS. 6 and 7.
Figure 9B:
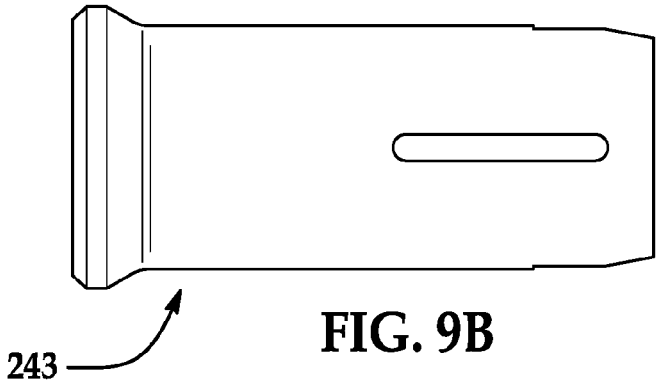
Figure 9C:
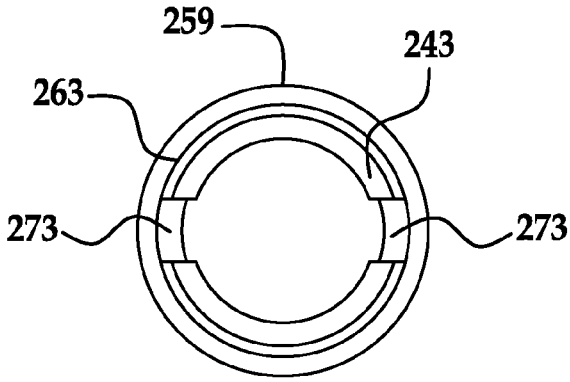

Exemplary embodiments of the present invention employ a ground shield design that may represent a substantial cost savings. As illustrated in the exemplary embodiment of FIGS. 6-7, ground shield 237, rather than being integrally formed as a unitary piece, is a composite of base portion 243 and ground electrode strap 239, which are formed separately and then secured together. As shown in FIGS. 8 and 9, ground electrode strap 237 is formed with a pair of legs 275, and base portion 243 is formed with axial extending slots 273 configured to fittingly receive the legs of the U-shaped ground electrode strap 239 at the end proximate to the axial electrode gap. Thus, to assemble ground shield 237, legs 275 of ground electrode strap 239 are fit within slots 273 and joined to otherwise open-ended base portion 243. In exemplary embodiments, legs 275 can be joined to slots 273 using a joining technique such as brazing, laser welding, resistance welding, or plasma welding, to secure the ground electrode strap to base portion 243.

Because base portion 243 and ground electrode strap 239 are formed separately, these two portions of ground shield 237 may be made from different materials. Thus, in exemplary embodiments, ground electrode strap 239 can be manufactured from an expensive, proprietary nickel alloy material such as, for example, Iconel to enhance durability between a center electrode tip (such as, for example, center electrode tip 33 depicted in the exemplary embodiment illustrated in FIG. 1) and ground electrode 257, while base portion 243 (which can comprise as much as 90% or more of the total size of ground shield 237 in exemplary embodiments) can be made from any low cost, corrosion resistant material such as any suitable metal-based alloy like stainless steel and similar steel-based alloys. Accordingly, by forming ground shield 237 by securing ground electrode strap 239 to otherwise open-ended base portion 243 as described, the need to fabricate the larger base portion from an expensive nickel alloy is avoided, thereby reducing the cost of forming the high-thread ground shield to as little as 10% or less of its former cost in exemplary embodiments.

Figure 10:
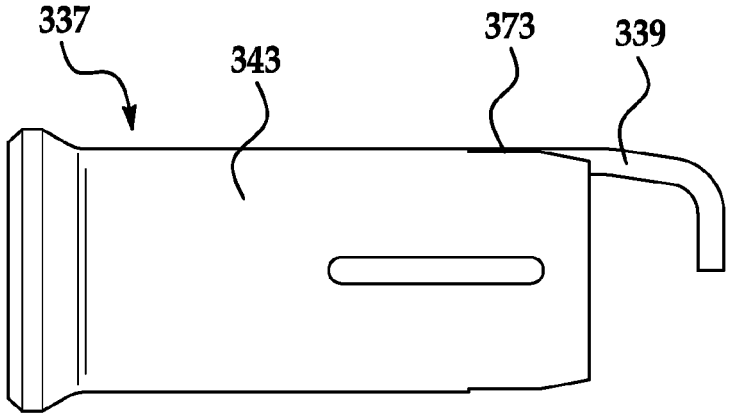
FIG. 10 is a side view of a ground shield for a spark plug in accordance with an exemplary embodiment of the present invention.

Furthermore, as shown in the alternative exemplary embodiment of a ground shield 337 illustrated in FIG. 10, cost can further be reduced by forming the ground shield as a composite of a base portion 343 and a generally J-shaped ground electrode strap 339 having a free end that is radially aligned with and axially spaced from a center electrode tip to form the spark gap, as illustrated in FIG. 10. In such an embodiment, the ground electrode strap will thus be formed with a single leg that is welded to base portion 343 in a single open slot 373. In yet another alternative exemplary embodiment, the ground electrode strap can be formed as a generally U-shaped member having an annular opening within free end in which a center electrode tip ends within or slightly below the annular opening.

The unique technique for fabricating a spark plug in accordance with exemplary embodiments of the present invention should now be clear. Referring again to the exemplary embodiment illustrated in FIGS. 1-4, center electrode 21 is axially into passed a bore formed within insulator 41 such that center electrode firing end or tip 33 projects from one end of the insulator, and terminal stud 23 can be passed into glass sealing material 15 of resistive element 13 to axially extend from the opposing end of the insulator. Insulator 41 and its included center electrode 21 are then axially passed into cylindrical shell ground shield 37 such that base portion 43 surrounds smaller diameter first insulator section 25, flared frustoconical section 31 engages insulator shoulder 29, and axial sparking gap 35 is formed between center electrode tip 33 and ground electrode tip 57.

Cylindrical annular retainer 59 is then axially passed over the insulator from the opposite end and its interior frustoconical ledge 71 engages insulator second shoulder 69 such that threaded section 61 surrounds larger diameter second insulator section 27 and jam nut 56 surrounds a portion of third insulator section 67. Frustoconical portion 63 of annular retainer 59 is then radially collapsed about frustoconical section 31 to secure ground shield 37 and annular retainer 59 together with insulator 41 being captured therebetween. In exemplary embodiments, frustoconical portion 63 of annular retainer 59 can be "hot pressed" onto frustoconical section 31, and jam nut 56 can be joined in a similar fashion onto third insulator section 67.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims and their legal equivalence.

What is claimed is:

1. A method of forming a spark plug for an internal combustion engine, the method comprising:

separately securing a ground electrode to a ground shield, the ground shield having an elongated base section being configured to substantially surround a first insulator section of an insulator configured to substantially surround a center electrode, the insulator having a substantially cylindrical body with at least the first insulator section and a second insulator section, the first and second insulator sections having first and second diameters respectively and being separated by an insulator shoulder; and the elongated center electrode having a center electrode tip at one end and a terminal proximate another end of the center electrode, wherein the ground shield has a frustoconical flange protruding from a first end of the elongated base section, the frustoconical flange being configured to engage the insulator shoulder, and wherein the ground electrode extends from a second end of the elongated base section to define a spark gap with respect to the center electrode tip; and securing the ground shield to the spark plug after the ground electrode has been separately secured to the ground shield.

2. The method as in claim 1, wherein the ground electrode is formed from a first material and the electrode base section is formed from a second material, the second material being different from the first material and wherein only the first material is suitable for maintaining the spark gap between the center electrode tip and ground electrode.

3. The method as in claim 1, wherein the elongated base section and the ground electrode are secured together using a joining technique selected from brazing, laser welding, resistance welding, plasma welding, and combinations thereof.

4. The method as in claim 1, wherein the ground electrode is formed as a generally U-shaped strap having pair of axially extending legs and a free end extending between the legs in a spaced relationship with the center electrode tip to define the spark gap, wherein the elongated base section is formed with a pair of axially extending slots proximate the second end, and wherein the pair of legs are welded to the elongated base section within the pair of axially extending slots to form the ground shield.

5. The method as in claim 4, wherein the free end of the generally U-shaped strap has an annular opening therein, and wherein the center electrode tip ends proximate the annular opening to define the spark gap.

6. The method as in claim 1, wherein the ground electrode is formed as a generally J-shaped strap having an axially extending leg and a free end extending from the leg in a spaced relationship with the center electrode tip to define the spark gap, wherein the elongated base section is formed with an axially extending slot proximate the second end, and wherein the leg is welded to the elongated base section within the axially extending slot to form the ground shield.

7. The method as in claim 1, wherein the ground electrode is formed with a plurality of axially extending legs and a free end extending from the legs in a spaced relationship with the center electrode tip to define the spark gap, wherein the elongated base section is formed with a plurality of axially extending slots proximate the second end, and wherein the plurality of axially extending legs are welded to the elongated base section within the plurality of axially extending slots to form the ground shield.

8. The method as in claim 1, wherein the ground electrode is manufactured from a nickel-based alloy material and the elongated base section is manufactured from a steel-based alloy material.

9. The method as in claim 1, wherein the center electrode tip has a first noble metal chip joined thereto facing the free end of the ground electrode, and wherein the free end has a second noble metal chip joined thereto axially facing the first noble metal chip to define the spark gap, the first and second noble metal chips serving as sparking surfaces of the spark plug.

10. The method as in claim 9, wherein the first and second noble metal chips are joined to the center electrode and the ground electrode respectively by a joining technique selected from brazing, laser welding, resistance welding, plasma welding, and combinations thereof.

11. The method as in claim 1, wherein the insulator has a third diameter section separated from the second diameter section by a second insulator shoulder, the second diameter section being located intermediate the first and third diameter sections and being greater in diameter than the first and third diameter sections.

12. The method as in claim 11, wherein an annular retainer substantially surrounds the second insulator section and partially surrounds the third insulator section, the annular retainer having a frustoconical end portion, and end nut portion, and a threaded portion therebetween, the annular retainer further including an internal frustoconical portion engaging the second insulator shoulder, the frustoconical end portion overlapping the frustoconical flange of the ground shield to secure the ground shield and the annular retainer together and capture the insulator therewithin.

13. The method as in claim 12, wherein the threaded portion of the annular retainer is configured to fit the spark plug into a threaded portion of a generally cylindrical opening communicating with a combustion chamber of an internal combustion engine, and wherein the frustoconical end portion of the annular retainer is configured to engage a frustoconical seat portion of the opening to establish an electrical ground between the ground shield and the engine while at the same time sealing the combustion chamber from the surrounding environment.

14. The method as in claim 13, wherein the threaded portion of the annular retainer has an outer diameter that is less than or equal to about 16 mm.

15. The method as in claim 1, wherein the center electrode includes an elongated firing electrode, a terminal electrode, and a resistive element situated therebetween, the firing electrode being connected to a first end of the resistive element through an electrically conductive glass seal that surrounds the resistive element, the terminal electrode being connected to a second end of the resistive element opposing the first end of the resistive element through the electrically conductive glass seal.

16. The method as in claim 14, wherein the firing electrode has an inner core comprising a highly heat conductive metal material and an insulating outer clad comprising a heat-resistant, corrosion-resistant metal material.

17. The method as in claim 1, wherein the annular retainer is made from a nickel-plated steel-based alloy material.

18. The method as in claim 1, wherein the insulator is made from a non-conducting ceramic material.

* * * * *